US005615995A

United States Patent [19]

Nobile et al.

[11] Patent Number: 5,615,995

[45] Date of Patent: Apr. 1, 1997

[54] MAIL PIECE STACKING MACHINE

[76] Inventors: John Nobile, 65 Forest Ave., Fairfield, Conn. 06430; John Hamma, 23 Sunnyside Ct., Milford, Conn. 06460

[21] Appl. No.: 402,937

[22] Filed: Mar. 13, 1995

[51] Int. Cl.[6] ..... B65G 57/00

[52] U.S. Cl. ..... 414/798.2; 271/181; 271/177

[58] Field of Search ..... 271/176, 177, 271/181, 182, 198, 199, 207, 220, 215; 414/798.4, 798.5, 794.4, 794.5, 798.2

[56] References Cited

U.S. PATENT DOCUMENTS

| | | | |
|---|---|---|---|
| 2,251,221 | 7/1941 | Cleven | 271/176 |
| 3,261,603 | 7/1966 | Peterson et al. | 271/86 |
| 3,700,232 | 10/1972 | Wiegert et al. | 271/75 |
| 3,774,783 | 11/1973 | Miller et al. | 271/181 |
| 4,056,264 | 11/1977 | Dhooge etal. | 271/177 |
| 4,428,573 | 1/1984 | Dennison, III et al. | 271/305 |
| 4,441,702 | 4/1984 | Nagel et al. | 271/177 |
| 4,500,085 | 2/1985 | Rayfield et al. | 271/207 |
| 4,546,871 | 10/1985 | Duke et al. | 271/182 |
| 5,137,415 | 8/1992 | Doeberl et al. | 414/798.5 |
| 5,244,344 | 9/1993 | Doeberl et al. | 414/798.2 |
| 5,295,680 | 3/1994 | Nishiguchi | 271/185 |
| 5,409,207 | 4/1995 | Freeman | 271/181 |
| 5,464,317 | 11/1995 | Foster et al. | 414/798.2 |
| 5,485,989 | 1/1996 | McCay et al. | 271/176 |

*Primary Examiner*—Karen B. Merritt
*Assistant Examiner*—Douglas Hess
*Attorney, Agent, or Firm*—Perman & Green

[57] ABSTRACT

A mail piece stacking machine is disclosed which is designed for use on conjunction with a mail piece processing or handling machine, such as a typical mailing machine, for stacking a plurality of pieces of mail as they are ejected seriatim from an outlet end of the processing or handling machine. The stacking machine has an elongate frame with a first feeding device consisting of a pair of cooperating rollers disposed adjacent the inlet end of the stacking machine, receives the mail pieces seriatim from the processing or handling machine and positively feeds the mail pieces into the stacking machine. A second elongate feeding device, consisting of a pair of belts traveling at a much slower speed than the first feeding device, receives the mail pieces in shingled overlapped relationship, and transports them to an upwardly angled stacking wall which causes the mail pieces to form a stack of mail pieces in the same upwardly angled orientation which progresses from the stacking wall toward the first feeding device.

16 Claims, 6 Drawing Sheets

MAIL PIECE STACKING MACHINE

SUMMARY OF THE INVENTION

The present invention relates generally to the field of mail stacking machines, and more particular to mail stacking machines which are designed and intended for use in conjunction with relatively small mailing machines or other mail processing or handling machines such as those normally used by small to medium volume mailers.

Mail stacking machines have long been well known, and have been used quite successfully in conjunction with mailing machines or other mail processing or handling machines, such as mail sorting machines, stamp cancellation machines, mail counting machines, inserting machines and envelope printing machines. Typically, these machines include an elongate frame which defines a feed path along which mail pieces are fed toward a stacking location, the feed path generally being disposed at a lower level than the mail piece output location of the mailing machine or other mail processing or handling machine, so that mail pieces ejecting by these machines fall upon an elongate conveyor belt mounted on the frame and which carries the mail pieces along the feed path to the stacking location, at the end of which there is an upwardly angled wall which forms a ramp against which the mail pieces are stacked by the conveyor belt. A relatively large pressure wheel is pivotally mounted over the conveyor belt at a point along the feed path which permits mail pieces ejected from the mailing machine or other mail processing or handling machine to fall on the conveyor belt before passing under the pressure wheel, which rests on mail pieces with sufficient pressure to cause them to cause them to maintain effective feeding contact with the conveyor belt. Mail pieces are ejected from the mailing machine or other mail processing or handling machine at a much greater linear speed than that at which the conveyor belt of the stacking machine is moving, so that the mail pieces fall upon the conveyor belt in a longitudinally shingled relationship, and are carried under the pressure wheel in that relationship toward the ramp. Thus, the mail pieces being pushed along the feed path between the conveyor belt and the pressure wheel force previously fed mail pieces to form a stack of angled mail pieces until the forward end of the stack approach the pressure wheel, at which time the stack of accumulated mail pieces must be removed from the stacking machine.

Stacking machines of this nature are typically in the order of 28 to 44 inches long and can accumulate a stack of mail that would reach a height of about 16 inches if stood on end. They are normally used with mailing machines or other mail processing or handling machines that can process and eject from 5,000 to 15,000 pieces of mail per hour, which translates into 80 to 250 mail pieces per minute, and therefore are utilized primarily by those who are involved in very large volume mailing operations, such as monthly billing, mass mailing, etc. To date, there is no commercially available stacking machine that is designed principally for use with mailing machines and other mail processing or handling machines with no more than one half the capacity of the larger machines, and more often than not with machines that would handle as few as 200 to 500 pieces of mail per day. One solution that has been offered to fill this void is a device generally referred to as a gravity stacker, which is little more than a suitably shaped container mounted adjacent the outlet end of the mailing machine or other mail processing or handling machine, and which is disposed at a lower level than the level at which the mail pieces are ejected so that they fall into the box. One serious limitation of this device is that the capacity is limited by the difference in height between the ejection location of the mailing machine or other mail processing machine or handling machine and the height of the container; considering the lower profile of modern mailing machine, the capacity of a gravity stacker is very limited if it is mounted on the same supporting surface as the mailing machine.

Another problem which is inherent with large stacking machines is that they are generally incapable of producing a neat, even stack of mail pieces since the mail pieces do not fall on the conveyor belt in precisely aligned overlying relationship, thereby resulting in a stack in which the mail pieces lie in slightly staggered relationship. This makes it difficult to handle a full size stack when it must be removed from the stacking machine. Although some have feed beds that are slightly angled toward a registration wall or conveyor belts that are similarly angled, these techniques have not generally produced satisfactory results.

Another problem generally encountered with large capacity stacking machines is that they do not stack thick mail pieces as effectively as they do thin mail pieces because the greater stiffness of thick mail pieces makes it harder to urge these mail pieces under the pressure wheel and to push them up the ramp.

Thus, there is a need for a relatively small, compact mail piece stacking machine that is suitable for use with small to medium volume mailing machine or other mail processing or handling machines, which reliably stacks mail pieces of varying sizes and thickness into a neat stack that can easily be handled.

BRIEF SUMMARY OF THE INVENTION

The present invention at least obviates if not eliminates the foregoing disadvantages of prior art mail piece stacking machines by providing a machine of this type ideally adapted for use with small to medium volume mailing machines or other mail processing or handling machines but which retains the basic advantage of automatic stacking of mail pieces of the larger stacking machines. Thus, the mail piece stacking machine of the present invention is itself relatively small and compact, can be mounted on the same supporting surface as the mailing machine or other mail processing or handling machine, produces a neat stack of mail pieces with uniformly arranged edges, will handle both thin and thick mail pieces up to about three eights of an inch thick, and is easy to use and maintain.

In its broader aspects, the principles of the present invention are embodied in a stacking machine adapted to be used in conjunction with a mail piece processing or handling machine for stacking a plurality of mail pieces as they are ejected seriatim from an outlet end of the mail piece processing or handling machine into the stacking machine into the stacking machine. The stacking machine generally comprise an elongate frame, means on the frame defining an elongate feed path along which mail pieces are adapted to be fed from an inlet end of the feed path to a stacking location extending along a portion of the path. A first feeding means is mounted on the frame adjacent the inlet end of the feed path for receiving mail pieces ejected seriatim from the mail processing or handling machine into the stacking machine. A second feeding means is mounted on the frame downstream from the first feeding means and extending along the feed path through the stacking location of the feed path for receiving mail pieces seriatim from the first feeding means in a generally horizontal orientation and for feeding them to the stacking location. A pressure means is pivotally connected to a portion of the frame which overlies the first feeding means, the pressure means overlying a portion of the second feeding means for exerting a generally vertical force on mail pieces disposed on the second feeding means to urge the mail pieces into effective feeding contact with the second feeding means. Finally, there is an stacking means disposed adjacent the downstream end of the feed path for arresting the movement of mail pieces being fed by the second feeding means and for causing the mail pieces to change from the generally horizontal orientation to a generally upwardly angled orientation, whereby continuous feeding of the mail pieces by the second feeding means causes the mail pieces to form a stack of mail pieces progressing from the stacking means toward the first feeding means.

In some of its more limited aspects, the first feeding means comprises a feed roller and a cooperating back up pressure roller mounted in the frame, and means for driving the feed roller at a rotational velocity such that the linear velocity of the peripheral surfaces of the feed roller and the pressure roller is at least slightly greater than the linear velocity of the mail pieces being ejected from the mail piece processing or handling machine, so that the lead edges of mail pieces being ejected from the mail piece processing or handling machine are gripped by the first feeding means to pull the mail pieces into the stacking machine.

The second feeding means comprises at least one elongate endless belt mounted on the frame to extend along the feed path from a position adjacent the first feeding means through the stacking location, the belt having an upper mail piece supporting run that is disposed at a lower level in the frame than the level at which the mail pieces exit from the first feeding means so that the mail pieces fall upon the upper run of the belt, and means for driving the belt such that the upper run thereof moves at a substantially slower linear velocity than that at which the mail pieces travel through the first feeding means, whereby the mail pieces fall upon said upper run of said belt in a shingled overlapping relationship.

The pressure means comprises an elongate pressure pad which has the triple functions of contacting the leading edges of mail pieces as they exit from the first feeding means for directing the leading edges of the mail pieces downwardly toward the upper run of the belt, urging the mail pieces into effective feeding contact with the upper run of the belt as the mail pieces move into and through the stacking location, and also urging the mail pieces toward a registration wall that extends along the stacking location so that the resulting stack of mail pieces has at least one longitudinal face in which the edges of the mail pieces are uniformly disposed.

The stacking means for causing the mail pieces to pivot upwardly to form the stack is mounted for angular movement so that the angle at which the stacking means is disposed can be adjusted for both thin and thick mail, the latter requiring a shallower upward angle because thick mail cannot bend to pivot upwardly as readily as thin mail.

Having briefly described the general nature and principal features of the present invention, it is a principal object thereof to provide a stacking machine which is uniquely designed and constructed for use in conjunction with low to medium volume mail piece processing or handling machines.

It is another object of the present invention to provide a mail piece stacking machine that is designed and constructed to be highly compact and present a small foot print in relationship to the mail piece processing or handling machines with which it is used.

It is still another object of the present invention to provide a mail piece stacking machine in which the leading edges mail pieces are positively gripped by feeding components in the stacking machine as soon as the leading edges enter the stacking machine and while trailing portions of the mail pieces are still in the mail piece processing or handling machines.

It is yet another object of the present invention to provide a mail piece stacking machine in which the leading edges of mail pieces are positively directed downwardly from the first feeding components to second feeding components and engaged therewith in effective feeding contact for movement to and through a stacking location where the mail pieces are formed into an upwardly angled stack.

It is a still further object of the present invention to provide a mail piece stacking machine which is capable of stacking relatively thick mail pieces with substantially the same degree of effectiveness as it does with thin mail pieces.

These and other features and advantages of the stacking machine of the present invention will become more apparent from an understanding of the following detailed description of a presently preferred mode of carrying out the principles of the invention, when considered in conjunction with the accompanying drawings.

DETAILED DESCRIPTION OF THE INVENTION

Figure 1:
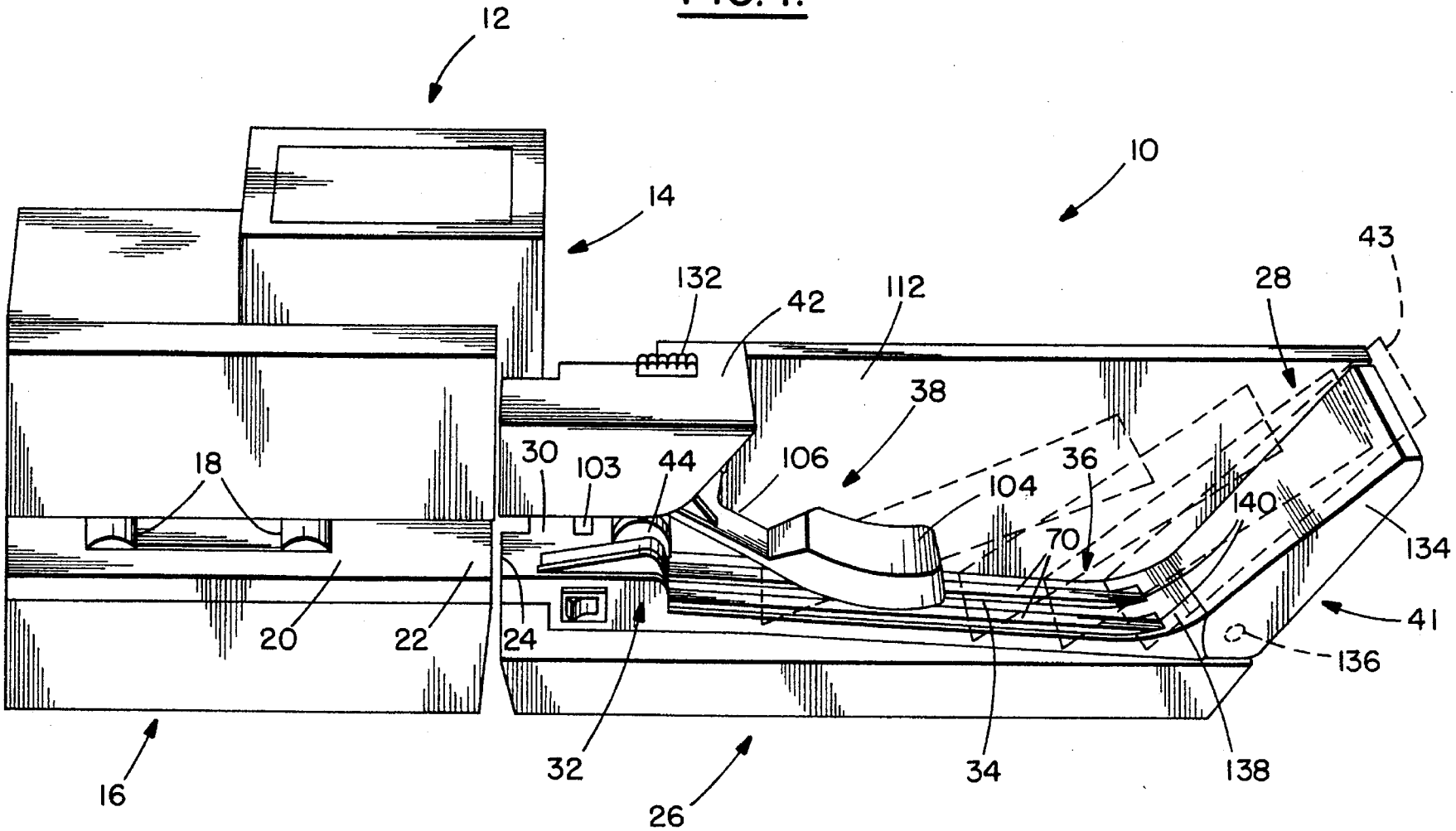
FIG. 1 is a perspective view of the stacking machine of the present invention illustrated in the position it would occupy during use in conjunction with a representative mailing machine.

Referring now to the drawings, and particularly to FIG. 1 thereof, the mail piece stacking machine of the present invention is generally indicated by the reference numeral 10, and it is shown as it would appear in actual use in conjunction with a mail piece processing or handling machine, which in the manner of use illustrated in the drawing, is a typical mailing machine generally indicated by the reference numeral 12. The mailing machine 12 consists broadly of a postage meter, indicated generally by the reference numeral 14, and a feed base, designated generally by the reference numeral 16 which includes suitable feeding elements 18 for feeding mail pieces along a feed deck 20 past the postage meter 14 which prints a suitable postage indicia on one comer of the mail pieces to evidence the payment of appropriate postage. It should be understood that the mailing machine 12 is shown for the purpose of illustration only, and that other mail piece processing or handling machines could be substituted for the mailing machine, such as any of these mentioned hereinbefore. It should also be noted that the stacking machine 10 and the mailing machine 12 are shown as being situated immediately adjacent to one another with the outlet end 22 of the feed deck 20 of the mailing machine 12 disposed adjacent to and at the same height as the inlet end 24 of the stacking machine 10. Although this is a convenient arrangement, it is not necessarily the only arrangement, since it is possible, if necessary, to interpose a suitable feeding device between the mailing machine 12 and the stacking machine 10 if they cannot be disposed adjacent to one another as shown, or the inlet end 24 of the stacking machine 10 could be at a different elevation than the outlet end 22 of the mailing machine, so long as it is possible to feed mail pieces either directly from one to the other or through the use of an intermediate feeding device.

Figure 2:
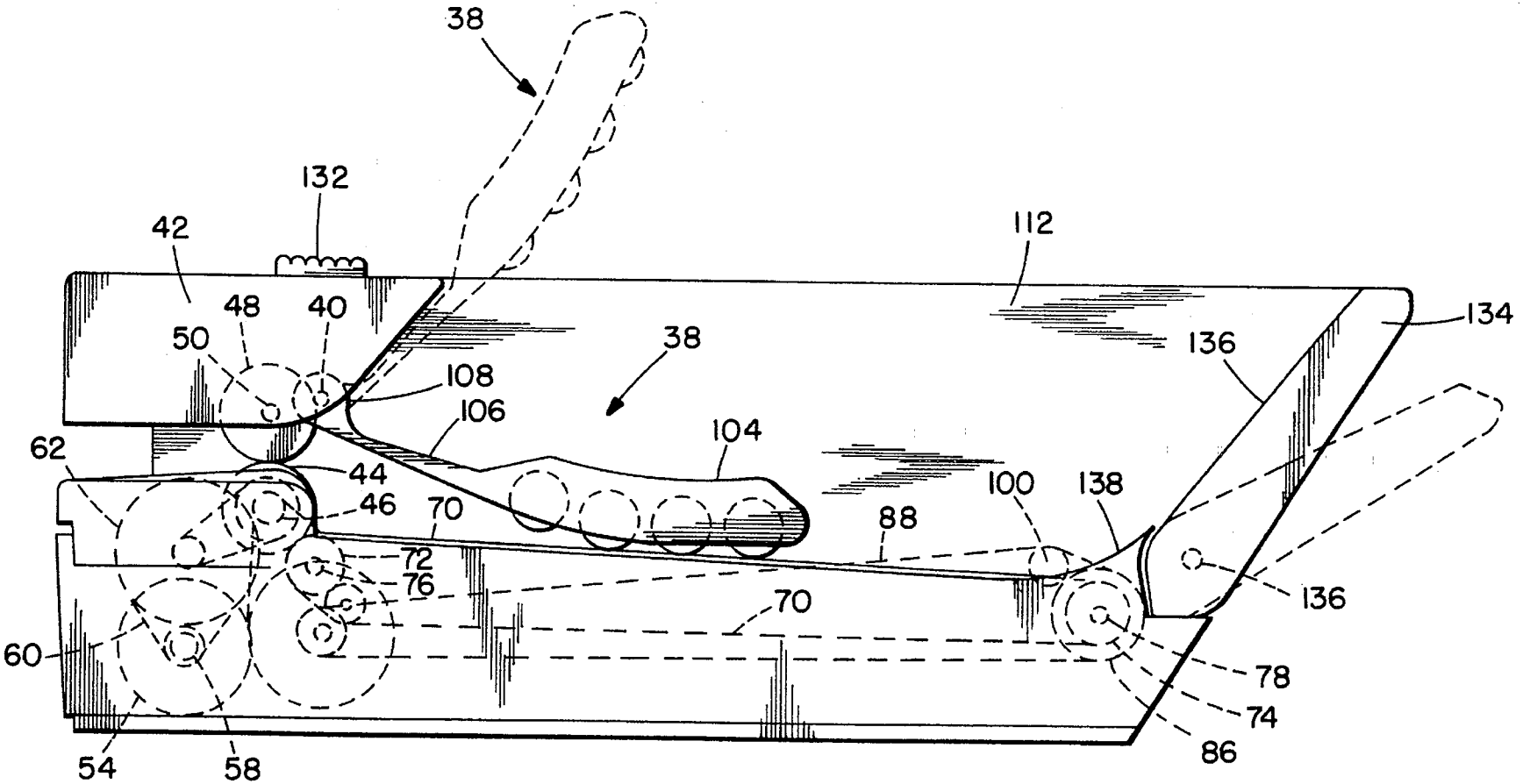
FIG. 2 is a front elevation of the stacking machine shown in FIG. 1, with the pressure means shown both in solid line operative position and in dotted line raised position which it assumes when the stacking machine is full.
Figure 3:
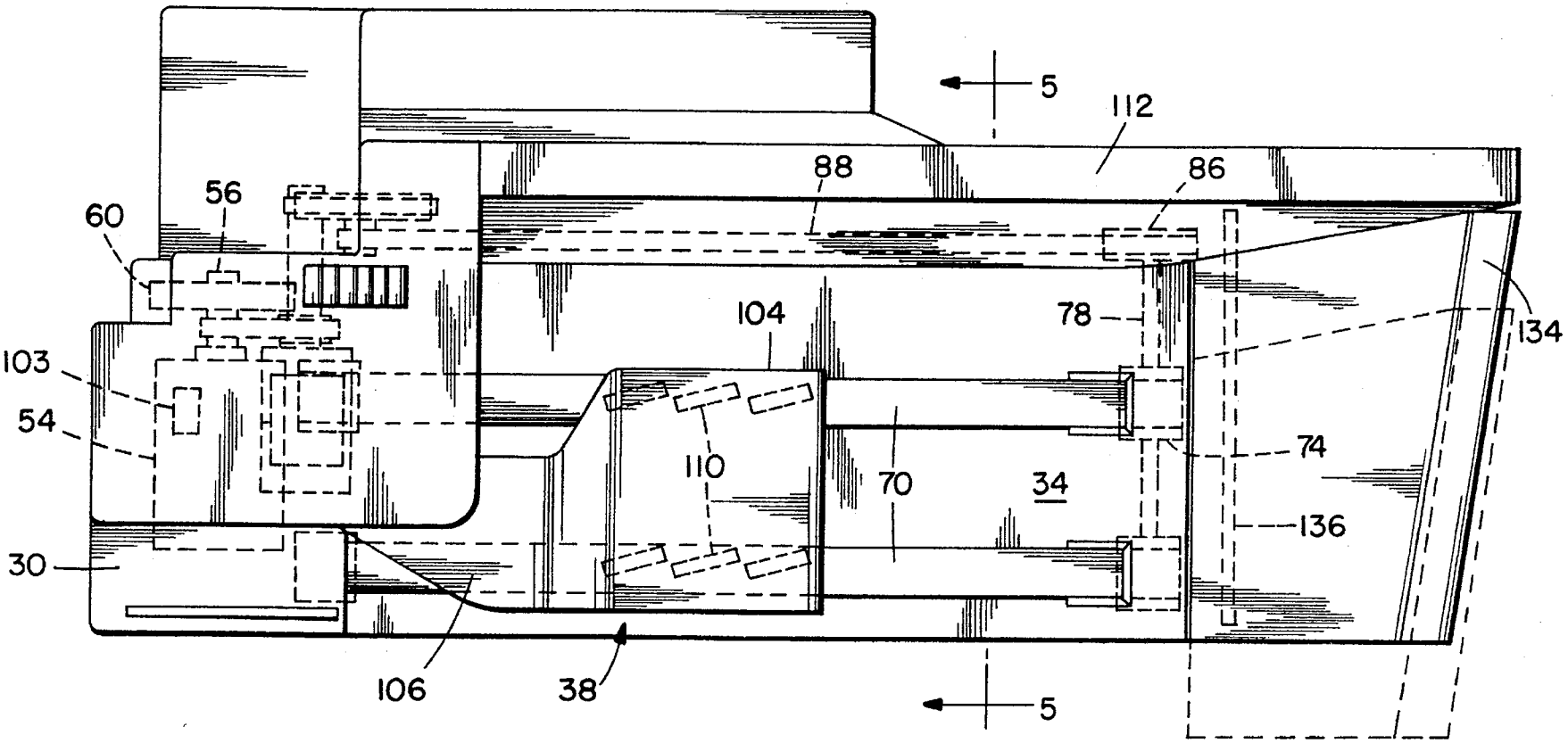
FIG. 3 is a top view of the stacking machine shown in FIG. 1 with hidden portions thereof shown in dotted lines.

With reference now to FIGS. 1, 2 and 3, the stacking machine 10 of the present invention includes any suitable form of elongate frame, designated generally by the reference numeral 26, on which are mounted as hereinafter described all of the operating components of the stacking machine 10. The frame 26 supports suitable means for defining an elongate feed path which extends from the inlet end 24 of the stacking machine 10 to a stacking location, indicated generally by the reference numeral 28, adjacent the opposite end of the stacking machine 10. The feed path includes a feed deck portion 30 which commences at the inlet end 24 of the stacking machine, and extends for a relatively short distance in a downstream direction to a first feeding means, indicated generally by the reference numeral 32 and further described below, which receives mail pieces that are ejected seriatim from the outlet end 22 of the mailing machine. The feed path then drops to a lower level where it is defined by another feed deck 34 (FIG. 3) which extends for a considerably longer distance than the feed deck 30 and terminates at the downstream end of the stacking machine 10 for receiving the mail pieces from the first feeding means 32 in a generally horizontal orientation and for feeding them to the stacking location 28. A second feeding means, indicated generally by the reference numeral 36 and further described below, extends along the feed deck 34 from the first feeding means 32 into and through the stacking location 28. A pressure means, indicated generally by the reference numeral 38 and further described below, is pivotally connected as at 40 (FIG. 2) to a housing portion 42 of the frame 26 that overlies and covers the first feeding means 32, the pressure means 38 extending along a portion of the second feeding means 34 for exerting a generally vertical force on mail pieces disposed on the second feeding means 36 to urge the mail pieces into effective feeding contact with the second feeding means 36, and also to direct the leading edges of mail pieces exiting from the first feeding means 32 downwardly to the second feeding means 36. An stacking means, indicated generally by the reference numeral 41 and further described below, is disposed adjacent the downstream end of the feed deck 34 for arresting the movement of mail pieces 43 being fed along the feed deck 34 by the second feeding means 36 and for causing the mail pieces 43 to pivot upwardly as shown to form a generally upwardly angled stack.

With reference now to FIGS. 1 through 4, it will be seen that the first feeding means 32 comprises a feed roller 44 mounted on a shaft 46 which is suitably journaled for rotation in a portion of the frame 26. A back up pressure roller 48 is mounted on a shaft 50 which is also suitably journaled for rotation and also limited vertical movement in a portion of the frame 26, the shaft 50 being biased downwardly by compression springs 52 suitably captured between the shaft 50 and a portion of the frame 26, or by other suitable resilient biasing means, so as to urge the pressure roller 48 into effective driving engagement with the feed roller 44. A projection 53 is suitably formed or mounted on the feed roller 44 and extends radially outwardly slightly beyond the periphery of the feed roller 44 so as to catch on the trailing edge of a mail piece as it exits from the nip of the rollers 44 and 48 to forcibly urge the trailing edge of the mail piece downwardly toward the second feeding means 36 in a manner more fully described below.

Figure 4:
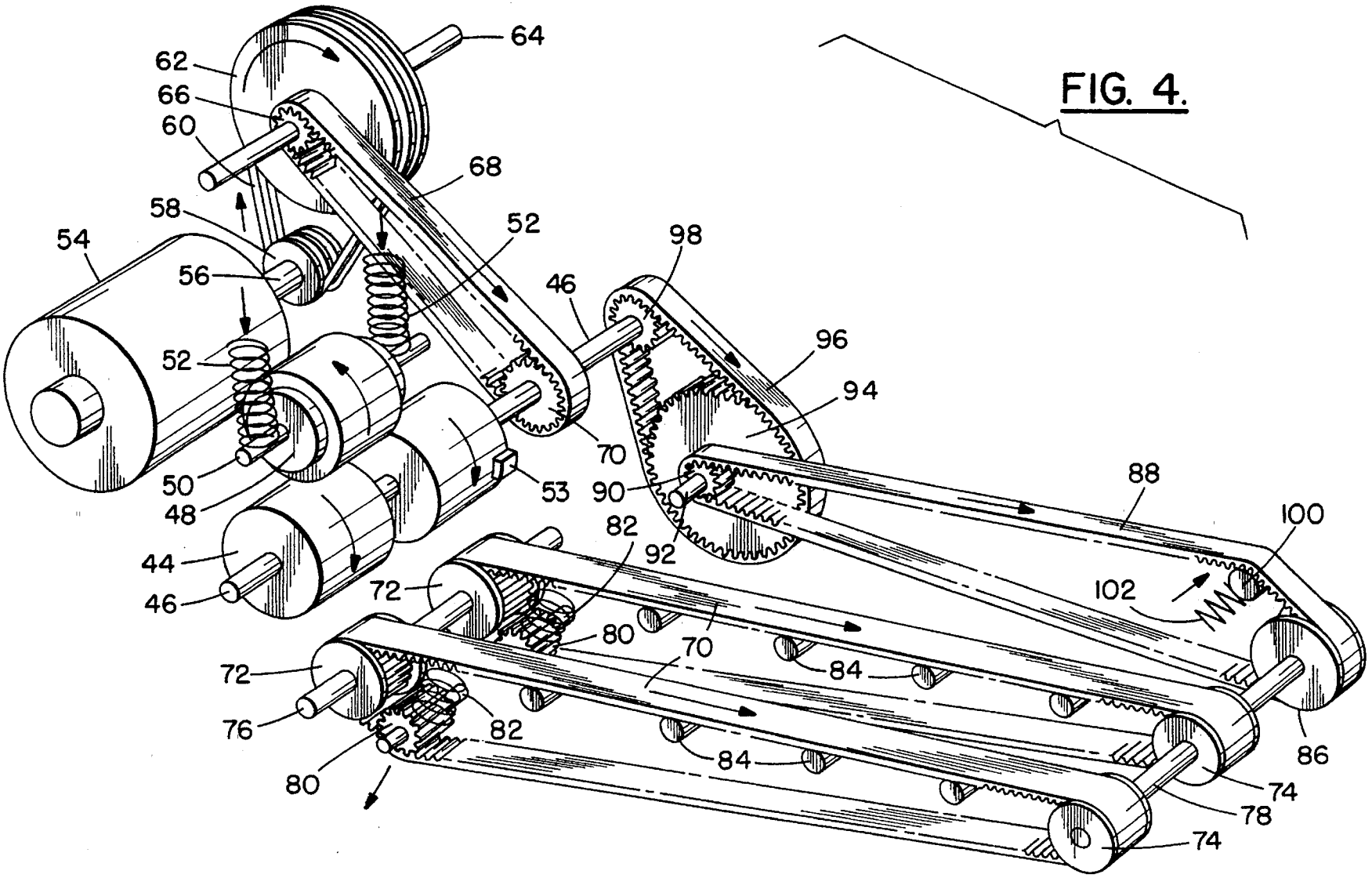
FIG. 4 is a diagrammatic exploded perspective view of all of the drive components of the stacking machine.

As best seen in FIG. 4, the feed roller 44 and shaft 46 are driven in the direction shown by the arrows by a motor 54 suitably mounted on a portion of the frame 26, the motor having an output shaft 56 which carries a pulley 58 which in turn drives a pair of belts 60. The belts 60 drive another larger pulley 62 which is mounted on a shaft 64 which is suitably rotatably mounted on a portion of the frame 26. The shaft 64 also carries a timing pulley 66 which drives timing belt 68, which in turn drives another timing pulley 70 mounted on the shaft 46, thereby rotating the feed roller 44. It will be seen that there is a considerably speed reduction between the pulleys 58 and 62, and between the pulley 62 and the timing gear 66, with the result that considerable torque is applied to the shaft 46 at a much slower angular velocity of the shaft 46 then the angular velocity of the motor shaft 56. As will be explained in more detail hereinafter, the speed reduction is adjusted so that the rotational velocity of the peripheral surfaces of the feed roller 44 and the pressure roller 48 is at least slightly greater than the linear velocity at which the mail pieces are ejected from the mailing machine 12 so that when the lead edges of mail pieces are gripped by the nip of the rollers 44 and 48, the mail pieces are actually pulled from the mailing machine 12 into the stacking machine 10.

Figure 5:
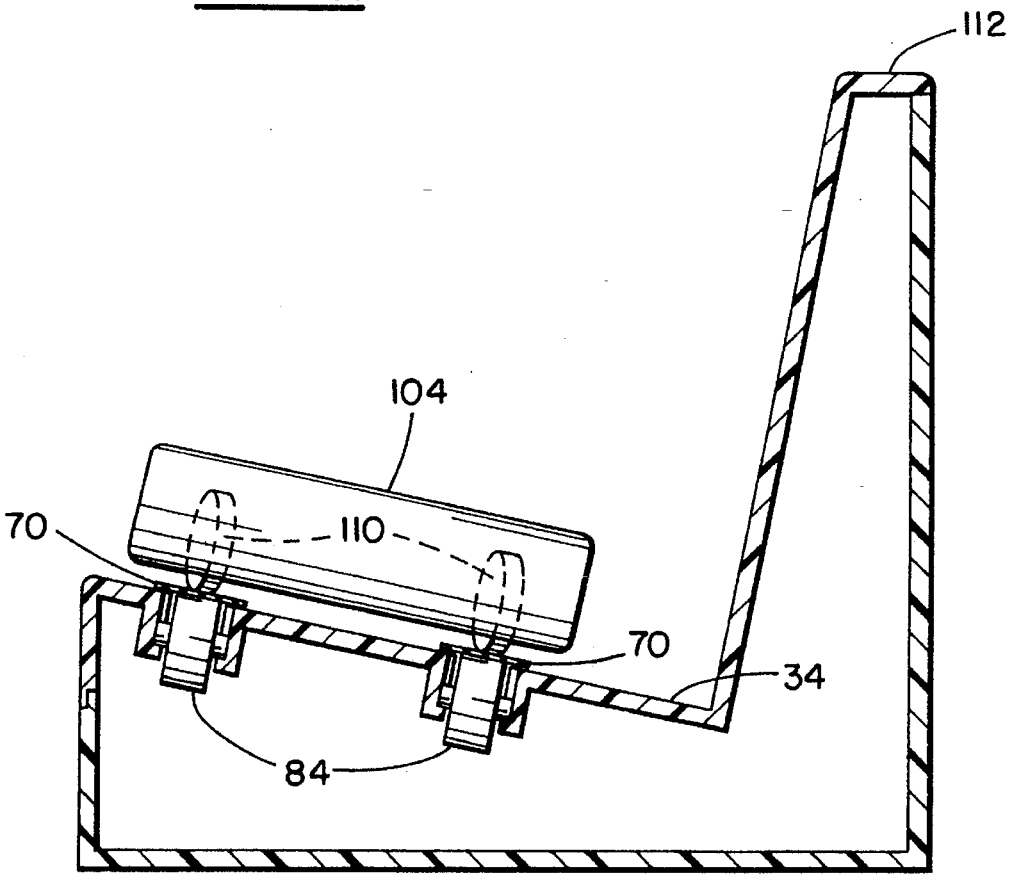
FIG. 5 is a sectional view through the stacking location taken on the line 5—5 of FIG. 3.

The second feeding means 36 comprises at least one, but preferably a pair of endless belts 70, preferably timing belts, each of which is mounted on a pair of timing pulleys 72 and 74 which are mounted on a pair of shafts 76 and 78 respectively suitably journaled for rotation on the frame 26. A pair of timing pulleys 80 are mounted on stub shafts 82 which are suitably journaled for rotation on the frame 26 and also for limited linear or angular movement, for example under the influence of resilient means, in order to apply a desired tension to the belts 70, in a manner well known in the art. A plurality of support rollers 84 are suitably journaled for rotation on the frame 26 in order to support the upper run of each belt 70 at a level slightly above the upper surface of the feed deck 34, as best seen in FIG. 5, and especially to assist in properly supporting the belts under the load of heavy mail pieces. The upstream shaft 76 is mounted generally in vertical alignment with, or slightly downstream from, the shaft 46 for the drive roller 48, so that the upstream end of the belts 70 extend beyond the point where the lead edges of mail pieces exit from the nip of the rollers 48 and 50, thereby ensuring that the lead edges of the mail pieces will land on the belts, as hereinafter further described. The downstream shaft 78 is mounted generally adjacent to the point at which the stacking means 41 is connected to the frame 26 at the stacking location, thereby ensuring that mail pieces lying on the belts 70 are carried fully into the stacking location 28.

As best seen again in FIG. 4, the belts 70 are driven by the timing gears 74 which are driven by the shaft 78 which in turn is driven by a timing gear 86 also mounted on the shaft 78. The gear 86 is driven by a timing belt 88 which passes around another gear 90 mounted on a stub shaft 92 that is suitably journaled for rotation in the frame 26. The shaft 92 is driven by a larger timing gear 94 which is mounted on the shaft 92 coaxially with the gear 90, the gear 94 being driven by another belt 96 which passes around another small gear 98 mounted on the shaft 46 that drives the feed roller 44. A small idler gear 100 is suitably journaled for rotation on the frame 26 and also for limited linear or angular movement, for example under the influence of resilient means such as the tension spring 102, in order to apply a desired tension to the belt 88, in a manner well known in the art. The drive gears 74 for the belts 80 are located at the downstream end of the feed deck so that the upper runs of the belts are always under tension, thereby preventing any undue slack in the belts from interfering with smooth feeding of the mail pieces. Also, it will be seen that a very substantial speed reduction between the shafts 46 and 92 is achieved through the small timing gear 98 driving the much larger timing gear 94 which in turn drives the shaft 92, with the result that the linear velocity of the belts 70 is considerably less than the rotational velocity of the peripheral surfaces of the rollers 44 and 48, for a purpose to be made clear hereinafter.

As seen in FIGS. 2 and 3, the stacking machine 10 is provided with a suitable sensor 103 located on the feed deck portion 30 upstream from the first feeding means 32 which is connected to the motor 54 through suitable circuitry that energizes the motor 54 instantly when the sensor 103 is covered by the leading edge of a mail piece, and which deenergizes the motor 54 at the end of a predetermined delay period after the sensor 103 is uncovered by the trailing edge of a mail piece. There are numerous ways well known in the art for causing the delay in deenergizing of the motor 54 after the sensor is uncovered, such as a digital or analog timing circuit, and the implementation thereof is obvious to one skilled in the art. It is necessary to prevent mail pieces from being transported by the belts 80 so far downstream that the trailing edges thereof pass the location at which the leading edges of succeeding mail pieces strike the belts 80 after being deflected downwardly by the pressure means 38 in the manner described below. If this occurs, a succeeding mail piece would not be in shingled overlapped relationship with a preceding mail piece, with the result that the leading edge of the succeeding mail piece would strike the trailing edge of the preceding mail piece with sufficient force to push it up the stacking means 41 and at least partially, if not completely, eject it from the stacking machine 10. The sensor 103 ensures that the shingled overlapped relationship is maintained regardless of the rate at which mail pieces are ejected from the mailing machine 12 by deenergizing the motor 54 at the end of the aforementioned delay period, which is when the trailing edge of a mail piece exits from the nip of the rollers 44 and 46 if the leading edge of a succeeding mail piece has not then reached the sensor 103 to maintain and motor 54 energized. The sensor 103 reenergizes the motor 54 when the leading edge of the next succeeding mail piece reaches the sensor 103.

The aforementioned pressure means 38 comprises a generally elongate pressure pad 104 and a longitudinally extending deflector portion 106 which terminates in the upstream direction in a connecting member 108 by which the pressure means 38 is pivotally connected as at 40 to the upstanding portion 42 of the frame 26. This allows the pressure means 38 to pivot from the operative position shown in solid lines in FIG. 2 to the dotted line position for a purpose to be made clear hereinafter. As best seen in FIGS. 2, 3 and 5, a plurality of rollers 110 are rotatably mounted on the underside of the pressure pad 104, the rollers 110 preferably being set an angle to the longitudinal axis of the pressure pad 104 so as urge mail pieces lying on the belts 70 toward a registration wall 112 which is formed integrally with, or suitably mounted upon a rear portion of, the frame 26 so as to extent along substantially the entire length of the belts 70. As best seen in FIG. 3, there is an elongate set of rollers 110 for each belt 70.

As best seen in FIG. 2, when the pressure pad 104 is in the normal operative position shown in FIG. 2, the under surface of the deflector portion 106 is disposed at an angle to the plane of the belts 70 so as to intercept the leading edges of mail pieces exiting from the nip of the rollers 44 and 48 to deflect the leading edges of the mail pieces downwardly toward the belts 70. This causes the mail pieces make contact with the belts 70 as soon as possible after exiting from the nip of the rollers 44 and 48 to ensure than the fall upon the belts 70 in a shingled overlapping relationship.

As best seen in FIG. 5, the feed deck 34 along which the belts 70 extend is set at a slight downward angle toward the registration wall 112 so as to assist the rollers 110 in urging mail pieces resting on the belts 70 toward the registration wall 112.

Figure 6:
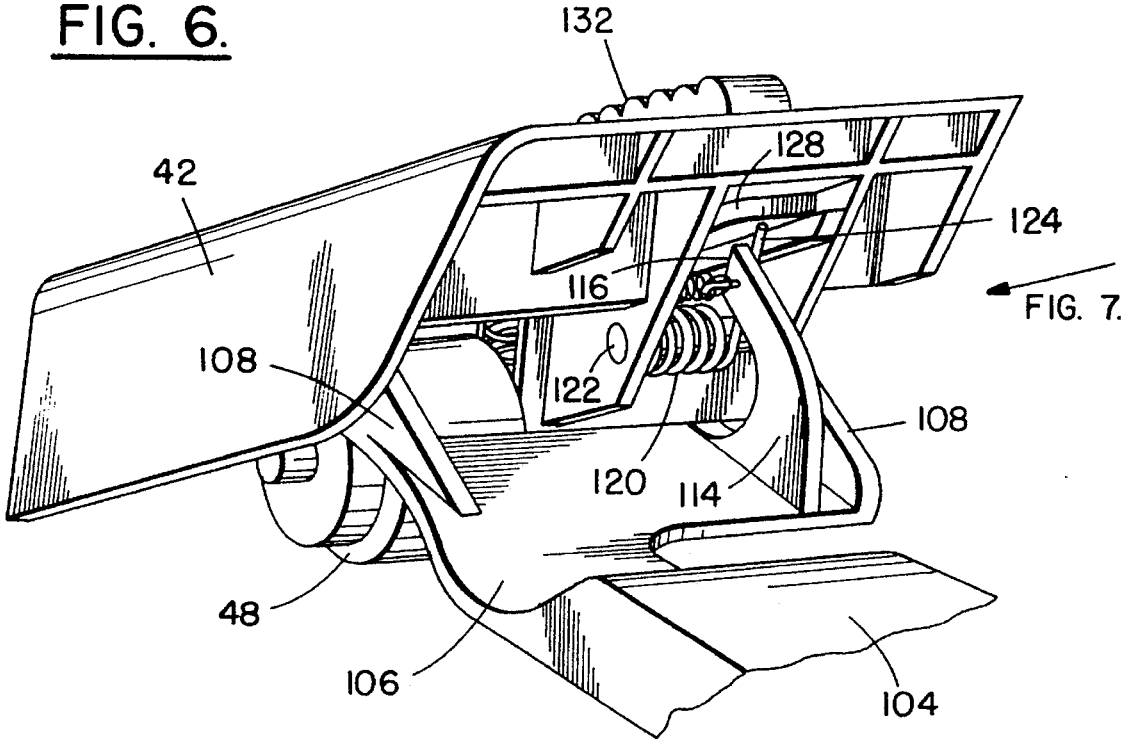
FIG. 6 is a fragmentary perspective view looking up and into the biasing mechanism for applying addition downward force to the mail piece pressure means.
Figure 7:
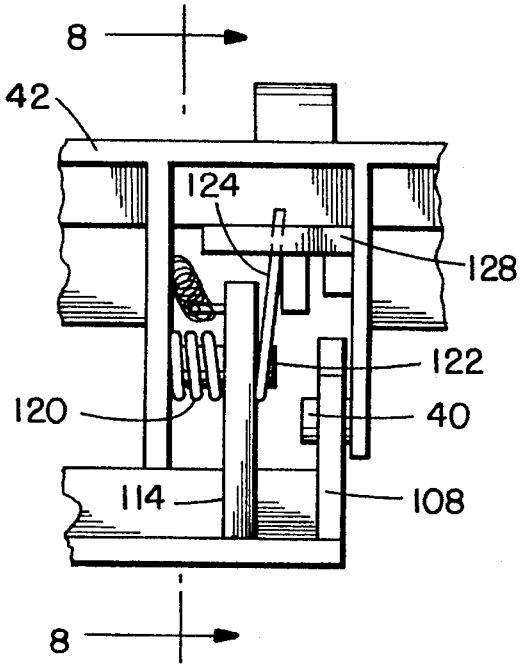
FIG. 7 is a fragmentary end view of the mechanism shown in FIG. 6, with the biasing spring in a disengaged position.
Figure 8:
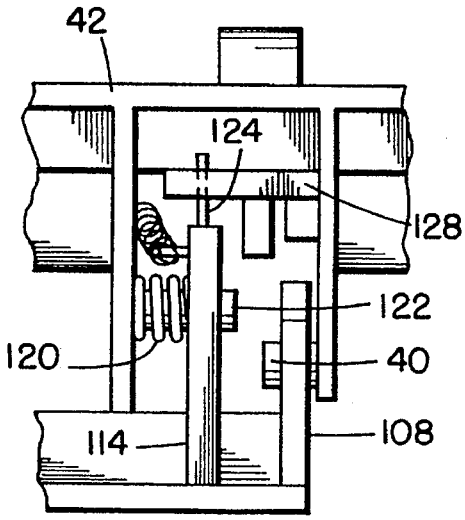
FIG. 8 is a view similar to FIG. 7 with the biasing spring in the engaged position.

The pressure means 38 is provided with means for adjusting the extent of the downward force exerted by the pressure pad 104 on mail pieces resting on the belts 70. With reference to FIGS. 6 through 9, it will be seen that an upwardly projecting arm 114 is mounted on a lateral extension of the deflector portion 106 adjacent the connecting members 108, the arm 114 being curved in the upstream direction of movement of the mail pieces and terminating in a flat wall 116 (FIG. 6). A tension spring 118 is connected at one end to the upper end of the ann 114 adjacent the wall 116 and at the other end to a suitable portion of the upper portion 42 of the frame 26, the spring 118 being selected to provide an upward force on the pressure means 38 which is slightly less than the downward gravity force of the pressure means 38, so that the rollers 110 apply a very light downward force on mail pieces lying on the belts 70, i.e., just enough to ensure an effective feeding engagement between the lower exposed surface portions of the shingled mail pieces and the belts 70 and also between adjacent contacting surface portions of the mail pieces. It has been found that excessive force on the shingled mail pieces tends to cause erratic feeding and shingling of the mail pieces with the result that they occasionally form clumps which interfere with neat, uniform stacking.

The situation is different, however, with respect to thick mail which is both heavier and stiffer than typical No. 10 envelopes typically used for commercial mail, and therefore requires greater downward force to ensure proper feeding and stacking. To provide this additional force, it will be seen that in the illustrated embodiment a torsion spring 120 is wrapped around a stud shaft 122 suitably affixed to a portion of the upper frame portion 42, and one end of the spring 120 is suitably secured to the upper frame portion 42. An elongate straight tang 124 is formed on the other end of the torsion spring 124 which projects upwardly from the stud shaft 122 and is displaced somewhat laterally so as to be offset from the arm 114 (FIG. 7) to permit the arm 114 to move past the tang 124 when the pressure means 38 is pivoted upwardly from the full line position shown in FIG. 2 toward the dotted line position.

Figure 9:
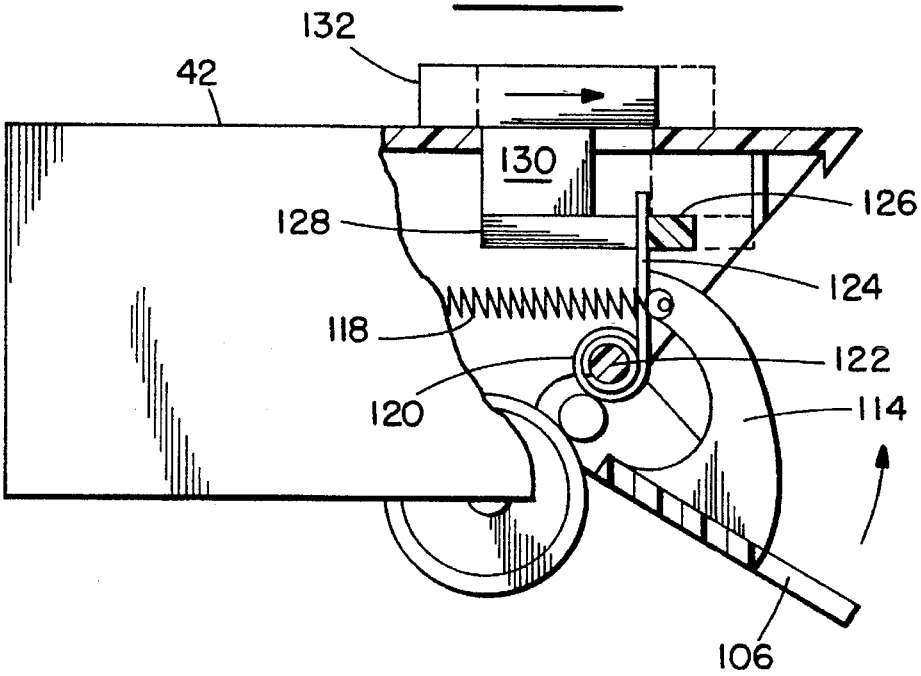
FIG. 9 is a fragmentary side view of the biasing mechanism shown in FIG. 6.

As best seen in FIG. 9, the upper end of the tang 124 is captured in an angled slot 126 formed in a slide member 128 which is fixed to a connecting piece 130 which in turn is fixed to a finger button 132 disposed on the upper surface of the upper portion 42 of the frame 26. A portion of the upstream side of the slide member 128 is cut away at the end of the slot 126 to permit the tang 124 to move in the upstream direction when it is abutting the wall 116 on the end of the ann 114. It will be readily seen, by comparing FIGS. 7 and 8, that when the finger button 132 is moved in a downstream direction, as from the solid line position shown in FIG. 9 to the dotted line position shown therein, the tang 124 is moved laterally by the skit 126 from the position shown in FIG. 7 to that shown in FIG. 8 in which the tang 124 is disposed in abutting relationship with the wall 116 on the upper end of the arm 114. In this position of the tang 128, when the pressure means 38 is raised, the wall 116 on the arm 114 presses on the tang 128 against the bias of the torsion spring 120, which bias is now added to the weight of the pressure means 38 (as offset by the tension spring 118), thereby adding to the downward force otherwise exerted by the pressure pad 104 on the mail pieces resting on the belts 70. In order to remove the bias of the spring 120 from the pressure means 38, it is only necessary to move the finger button 132 back to the solid line position shown in FIG. 9, which reengages the upper end of the tang 120 with the angled slot 126 to move the tang 128 back to the offset position shown in FIG. 7.

It should be understood that the foregoing construction is a presently preferred mode of means for varying the downward force of the pressure pad 104 on mail pieces lying on the belts 70, but that other modes are contemplated within the spirit of the invention. For example, the torsion spring 120 could be replaced with an elongate compression spring loaded cylinder, or a small hydraulic or pneumatic piston and cylinder device, working against the upper end wall 116 of the arm 114, both having means for displacing the end of the device adjacent the wall 116 laterally so that the am 114 can freely move up and down when the additional force of the device is not required. A viscous dampening device may also be used ill place of the spring and would have a similar effect.

The stacking means 41 comprises a substantially flat mail piece stacking wall 134 which is pivotally mounted on a shaft 136 suitably secured to the frame 26 adjacent the downstream ends of the belts 70. In the normal position of the stacking wall 134, the upper surface 136 of the stacking wall 134 is disposed at a substantially upward angle relative to the plane of the belts 70, preferably in the range of about 30° to 45°. As best seen in FIG. 2, the feed deck 34 has a slight upward curvature 138, which include a pair of rectangular openings 140 (FIG. 1) through which the belts 70 pass to engage the downstream timing gears 74, although, alternatively, this curvature could be incorporated into the stacking wall 134. Thus, the function of the stacking wall is to intercept the leading edges of the mail pieces as they are moved through the stacking location and cause the mail pieces to pivot upwardly The stacking wall 134 is pivotally attached to the shaft 136 so that it can be lowered from the solid line position shown in FIG. 2 to approximately the dotted line position, in which the upper surface 136 of the stacking wall 134 is disposed at an angle to the upper surface 136 in the range of about 15° to 25°. The purpose for this is to reduce the angle at which mail pieces 43 must be pivoted in order to be stacked to accommodate thick mail pieces that cannot be pivoted upwardly by the belts 70 to the same extent as the thin mail pieces with which the stacking machine is customerily used. Any suitable means for holding the stacking wall 134 in the solid line and dotted line positions of FIG. 2 may be utilized.

The stacking wall 134 is also slidably mounted on the shaft 136 so as to be laterally movable away from the registration wall 112 for a limited distance to the dotted line position shown in FIG. 3, and when in this position it can be lowered to the dotted line position shown in FIG. 2. The lateral movement positions the stacking wall 134 to properly support wider mail pieces than the typical #10 width that accounts for the great bulk of the mail pieces that the stacking machine is designed to handle. The downward movement reduces the angle through which mail pieces must pivot from lying horizontally on the belts 80 to the upwardly angled position of fully stacked mail pieces in order to accommodate thick mail pieces which are relatively stiffer than thin mail pieces and cannot bend as easily.

In operation, the stacking machine 10 is placed preferably on the same supporting surface, such as a table or desk, as the mailing machine 12, or the other mail piece processing or handling machine, with the inlet end 24 of the stacking machine immediately adjacent to the out end of the mailing machine 12. When power is applied to the motor 54, the pulley 58 drives the larger pulley 62 through the belts 60 to drive the shaft 64, gear 66 and belts 68, which in turn drive the gear 70, shaft 46 and feed rollers 44 and pressure roller 48. As mail pieces are ejected from the mailing machine 12, the leading edges of the mail pieces are gripped by the nip of the feed roller 44 and the pressure roller 46 and pulled into the stacking machine, since the linear speed of the peripheral surfaces of the rollers 44 and 48 is slightly greater than the liner speed at which the mail pieces are traveling as they are ejected from the mailing machine.

After exiting from the nip of the rollers 44 and 48, the leading edges of the mail pieces contact the undersurface of the deflector portion 106 of the pressure means 38 and are deflected downward toward the belts 80, the latter being driven by the gear 98, belt 96, gears 94 and 90, shaft 92, belt 88, gear 86, shaft 78 and gears 74. As noted above, the linear speed of the belts of considerably slower than the linear speed of the mail pieces passing through the rollers 44 and 48, with the result that the leading edges of successive standard size mail pieces are pushed under the pressure pad 104 until the trailing edges thereof exit from the nip of the rollers 44 and 48, at which time the raised projection 53 strikes the trailing edges of the mail pieces to forcibly move them downward so that the mail pieces then lie flat on the belts 80 and are moved toward the stacking location 28 at the same speed as the belts 80. The raised projection 53 will always strike the trailing edges of the mail pieces because of the speed differential between the linear speed of the peripheral surfaces of the rollers 44 and 48 and the linear speed of the belts 80, the latter being only about one fifth that of the former. Thus, as soon as the trailing edge of a mail piece exits the nip of the rollers 44 and 48, it immediately slows to the linear speed of the belts 80, and that provides sufficient time for the feed roller 44 to rotate a few times before the trailing edge of the mail piece is beyond the orbital path of the projection 53. As succeeding mail pieces are fed from the rollers 44 and 48, they drop onto the belts 80 in a shingled overlapped relationship, with a small portion of the length of each lower mail piece protruding ahead of the next upper mail piece and with the major portion of the length of each lower mail piece being covered by the next upper mail piece.

As the mail pieces in this arrangement reach the stacking location, the leading edges thereof are slightly elevated by the curved portion 138 of the feed deck 34, after which they moved up the upwardly angled surface 136 of the stacking wall 134 until the trailing edges of the mail pieces, shows in dotted lines as 43 in FIG. 1, assume an upwardly angled position corresponding to the angle of the surface 136 of the stacking wall 134, with the trailing edges of the mail pieces resting on the moving belts 70. As mail pieces continue to be fed by the belts 70 toward the stacking wall 134, they accumulate in a stack that progresses from the stacking wall 134 toward the upstream end of the belts 70. After a certain quantity of mail pieces has been accumulated in the stacking machine, the incoming mail pieces begin to raise the pressure pad 104 from the solid line position shown in FIG. 2 toward the dotted line position, and when the pressure pad 104 is approximately at the dotted line position, the stacking machine is full and it is necessary to remove the accumulated stack of mail pieces from the stacking machine, which can be accomplished without interrupting the smooth flow of mail pieces into the stacking machine.

As an option if desired, it is possible to mount a switch in a suitable location on or adjacent to the housing 42 which is actuated by a suitable portion of the pressure means 38 when it is raised to the dotted line position shown in FIG. 2, the purpose of the switch being to stop the mailing machine 12 so that the flow of mail pieces into the stacking machine 10 is interrupted when it is full. The advantage of this is that the entire mail piece feeding and stacking operation is shut down when the stacking machine is full in the event that an operator cannot be present at all times when the mailing machine and the stacking machine are in operation.

It is to be understood that the present invention is not to be considered as limited to the specific embodiment described above and shown in the accompanying drawings, which is merely illustrative of the best mode presently contemplated for carrying out the invention and which is susceptible to such changes as may be obvious to one skilled in the art, but rather that the invention is intended to cover all such variations, modifications and equivalents thereof as may be deemed to be within the scope of the claims appended hereto.

We claim:

1. A stacking machine adapted to be used in conjunction with a mail piece processing or handling machine for stacking a plurality of pieces of mail as they are ejected seriatim from an outlet end of the mail piece processing or handling machine into the stacking machine, said stacking machine comprising:

A. an elongate frame,

B. means on said frame defining an elongate feed path along which mail pieces are adapted to be fed from an inlet end of said feed path to a stacking location extending along a portion of said feed path, C. first feeding means mounted on said frame adjacent said inlet end of said feed path for receiving mail pieces ejected seriatim from the mail processing or handling machine into said stacking machine, said first feeding means operable at a rate of speed such that the linear velocity of mail pieces grasped by said first feeding means is at least equal to or greater than the linear velocity of mail pieces being ejected from the mail piece processing or handling machine, D. second feeding means mounted on said frame downstream from said first feeding means and extending along said feed path through said stacking location in said feed path for receiving mail pieces seriatim from said first feeding means in a generally horizontal orientation and for feeding them into and through said stacking location, E. pressure means pivotally connected to a portion of said frame overlying said first feeding means, said pressure means overlying a portion of said second feeding means for exerting a generally vertical force on mail pieces disposed on said second feeding means to urge the mail pieces into effective feeding contact with said second feeding means, and F. stacking means disposed adjacent the downstream end of said feed path for arresting the movement of said mail pieces being fed by said second feeding means and for causing said mail pieces to change from said generally horizontal orientation to a generally upwardly angled orientation, whereby continuous feeding of said mail pieces by said second feeding means causes said mail pieces to form a correspondingly upwardly angled stack of said mail pieces progressing from said stacking means toward said first feeding means.

2. A stacking machine as set forth in claim 1 wherein said first feeding means comprises:

A. a feed roller mounted on said frame adjacent to said inlet end of said feed path, B. a back up pressure roller mounted in cooperating driving engagement with said feed roller, C. resilient means for urging said pressure roller into driving engagement with said feed roller, and D. means for driving said feed roller at a rotational velocity such that the linear velocity of the peripheral surfaces of said feed roller and said pressure roller is at least equal to or exceeds the linear velocity of mail pieces being ejected from the mail piece processing or handling machine, whereby the lead edges of mail pieces being ejected from the mail piece processing or handling machine are gripped by said first feeding means to pull the mail pieces into said stacking machine.

3. A stacking machine as set forth in claim 2 wherein said second feeding means comprises:

A. at least one elongate endless belt mounted on said frame to extend along said feed path from a position adjacent said first feeding means through said stacking location, said belt having an upper mail piece supporting run that is disposed at a lower level in said frame than the level at which the mail pieces exit from said first feeding means so that the mail pieces fall upon said upper run of said belt, and B. means for driving said belt such that said upper run of said belt moves at a substantially slower linear velocity than the rotational velocity of said peripheral surfaces of said feed roller and said pressure roller, whereby the mail pieces fall upon said upper run of said belt in a shingled overlapping relationship.

4. A stacking machine as set forth in claim 3 wherein said first feeding means includes means for engaging the trailing edges of the mail pieces to cause said trailing edges of the mail pieces to be forcibly moved toward said upper run of said belt to ensure that the mail pieces lie flat on said belt.

5. A stacking machine as set forth in claim 4 wherein said means for engaging the trailing edges of the mail pieces comprises an abutment finger formed on the periphery of said feed roller for engaging the trailing edge of a mail piece as said trailing edge is ejected from between said cooperating feed and pressure rollers.

6. A stacking machine as set forth in claim 3 wherein said pressure means comprises an elongate pressure pad having:

A. means for engaging the leading edges of mail pieces as they exit from said first feeding means for directing the leading edges of the mail pieces downwardly toward said upper run of said belt, and B. means for urging the mail pieces into effective feeding contact with said upper run of said belt.

7. A stacking machine as set forth in claim 6 wherein said means for directing the leading edges of the mail pieces downwardly toward said upper run of said belt comprises a downwardly slanted portion of the lower surface of said pressure pad when said pressure pad is disposed in a generally horizontal orientation on mail pieces lying on said upper run of said belt.

8. A stacking machine as set forth in claim 7 wherein said means for urging the mail pieces into effective feeding contact with said upper run of said belt comprises means disposed on the lower surface of said pressure pad for contacting mail pieces as they are deposited on said upper run of said belt by said downwardly slanted portion of said lower surface of said pressure pad.

9. A stacking machine as set forth in claim 8 wherein said said mail piece contact means comprises a plurality of rollers rotatably mounted on said pressure pad which project below said lower surface of said pressure pad so as to have rolling contact with the upper surfaces of the mail pieces as they are moved by said second feeding means.

10. A stacking machine as set forth in claim 9 wherein

A. said frame includes an elongate registration wall extending along substantially the length of said stacking location on said feed path, and B. said rollers are mounted in said pressure pad at an angle to the longitudinal axis of said second feeding means so that said rollers tend to urge the mail pieces toward said registration wall as the mail pieces are moved by said second feeding means.

11. A stacking machine as set forth in claim 10 wherein said second feeding means is mounted on said frame so as to be set at a slight downward angle toward said registration wall to assist said rollers in urging the mail pieces toward said registration wall.

12. A stacking machine as set forth in claim 11 wherein said pressure means includes means for varying the amount of said generally vertical force exerted on the mail pieces by said pressure pad.

13. A stacking machine as set forth in claim 12 wherein said means for varying the amount of said generally vertical force comprises:

A. spring means operatively interconnected between said pressure means and said portion of said frame to which said pressure means is pivotally connected for exerting an additional generally vertical force on said pressure means, and B. actuating means for alternately engaging and disengaging said spring means from said pressure means, whereby the generally vertical force exerted by said pressure pad is increased when said spring means engaged with said pressure means and decreased when said spring means is disengaged from said pressure means.

14. A stacking machine as set forth in claim 1 wherein

A. said stacking means comprises a generally upwardly angled mail piece stacking wall attached to said frame substantially at the downstream end of said stacking location such that the upper surface of said stacking wall is disposed at an upward angle with respect to the upper surface of said second feeding means so that said stacking wall intercepts the leading edges of the mail pieces and pivots the mail pieces upwardly to arrest the forward movement thereof and to cause the mail pieces to form a stack in which the mail pieces are disposed at approximately said upward angle of said upper surface of said stacking wall, B. said frame includes an elongate registration wall extending along substantially the length of said stacking location on said feed path, and C. said stacking wall is slidably connected to said frame for relative lateral movement with respect to said registration wall so that said stacking wall can be moved laterally away from said registration wall to accommodate mail pieces that are wider than the width of the bulk of mail pieces for which the stacking machine is designed.

15. A stacking machine as set forth in claim 14 wherein said stacking wall is also pivotally connected to said frame for relative angular movement with respect to said frame so that said upward angle of said stacking wall can be adjusted downwardly to accommodate mail pieces which are thicker and therefore stiffer than an average thickness of the bulk of mail pieces which are customarily fed into the stacking machine.

16. A stacking machine as set forth in claim 1 further including control means for actuating and deactuating said first and second feeding means in synchronism with the arrival of mail pieces ejected seriatim from the mail processing or handling machine, said control means being responsive to the arrival of the leading edge of a mail piece into said stacking machine to actuate said first and second feeding means and responsive to the passing of the trailing edge of the mail piece to deactuate said first and second feeding means at the end of a predetermined delay period after said trailing edge of the mail piece has passed said control means.

* * * * *